United States Patent [19]

Christensson

[11] 3,942,708

[45] Mar. 9, 1976

[54] LIQUID AND AIR TIGHT PACKAGE

[75] Inventor: Od Wikar Christensson, Stockholm, Sweden

[73] Assignee: Christenssons Maskiner & Patenter Aktiebolag, Sweden

[22] Filed: Mar. 1, 1974

[21] Appl. No.: 447,355

[30] Foreign Application Priority Data

Mar. 16, 1973 Sweden ..... 7303698

[52] U.S. Cl. ..... 229/14 BA; 229/48 T

[51] Int. Cl.[2] ..... B65D 5/56; B65D 25/14

[58] Field of Search ..... 229/14 B, 14 BL, 48 T, 229/48 SA

[56] References Cited

UNITED STATES PATENTS

| | | | |
|---|---|---|---|
| 695,273 | 3/1902 | Birnie et al. | 229/14 BA |
| 2,284,604 | 5/1942 | Brooks | 229/48 T UX |
| 2,407,802 | 9/1946 | Stotter | 229/14 BA |
| 2,440,664 | 4/1948 | Irons | 229/48 T UX |
| 2,930,517 | 3/1960 | Mensing et al. | 229/14 BA |
| 2,950,036 | 8/1960 | Vergobbi | 229/14 BA |
| 2,979,247 | 4/1961 | Pellaton et al. | 229/14 BA |
| 3,172,593 | 3/1965 | Potter | 229/14 BL UX |
| 3,343,750 | 9/1967 | Desmond et al. | 229/48 SA X |
| 3,411,694 | 11/1968 | Silver | 229/48 T X |

*Primary Examiner*—Davis T. Moorhead

*Attorney, Agent, or Firm*—Larson, Taylor and Hinds

[57] ABSTRACT

A fluid tight container having an outer blank with top and bottom closing flaps and a lining laminated over substantially the entire inner surface thereof and extending beyond the top and bottom flaps and laterally beyond one side edge of the outer blank and folded thereover. In the finished state of the blank, the inside of the outer blank at the side thereof opposite the folded over lining portion is attached to the outside of the outer blank at the folded over lining portion. The longitudinal ends of the lining extending beyond the closing flaps are sealed together to form sealed container ends.

6 Claims, 10 Drawing Figures

LIQUID AND AIR TIGHT PACKAGE

The present invention refers to a liquid and gas tight container and a method and an apparatus for manufacturing same.

The invention is more particularly directed to such a container, which is made of cardboard or any other stiff material and which is at least on the inside formed with a sealing layer of a thin metal, a plastic coated metal foil, a metallized plastic foil or the like.

Two different types of containers of this kind are previously known. In one type the cardboard material is covered with the sealing layer in the manufacturing of the cardboard material, and the container blank is punched out from this cardboard material and is glued or welded together to form a liquid container. For various reasons the cardboard material however must be fairly thick and for this reason the sealing of the container which usually takes place by welding of the inner sealing layer of the cardboard material has to be performed at such a high temperature that the container may be damaged or miscoloured and so that there may sometimes even be some destruction of taste in the contained food stuff. The thickness and stiffness of the cardboard material also makes it difficult to obtain a completely tight container, in particular a gas tight container, and further the cardboard material for such a package is often difficult to handle due to its thickness and stiffness.

In order to avoid the said disadvantages the previously known container of the second type is formed with an inner and sometimes also an outer sealing lining of metal, plastic or similar thin material which separately or in connection with the formation and erection of the outer package is sealed without intermeditate layer of the thick cardboard material. Suitably the lining has to be thin and has to extend up above the upper edge of the outer package cardboard material whereby the lining may simply be closed separately so as to obtain a completely tight inner container in which the lining does not run the risk of breaking or bursting due to the stretching during the formation of the package.

A package of this kind is previously known, which comprises an envelope of cardboard material and a lining of plastic material applied in said envelope. When manufacturing the said container the cardboard material and the lining material are punched independently of each other and the lining is folded together and formed to an elongated tube by means of a longitudinal joint, whereupon the lining tube thus formed is attached to one or perhaps two sides of the punched outer package of cardboard by means of glue points. Then the outer package is folded together around the lining tube, and the lining tube and subsequently the outer package are closed and sealed independently of each other.

It has however shown that such a package involves some disadvantages. The lining containing the packed product rests loosely within the outer package except for the few points where the lining is attached to the outer package. Due to vibrations in connection to transportation the lining may therefore move somewhat in relation to the outer package, in particular in liquid containers, and the said small movements may cause ruptures and subsequent leakages of the lining. It also has been shown to be very difficult to have the lining penetrate closely into the corners of the outer package and since the lining does not penetrate completely into said corners there will be stretchings in the lining in particular when closing and sealing the outer package, and also the said stretching may cause ruptures and subsequent leakages.

Since the outer package made of cardboard or similar material is hygroscopic the containers are usually sensitive to moisture and are not suited for packing such goods which have to be subjected to a sterilization process which is generally accomplished by means of overheated steam or otherwise in a damp atmosphere.

The container also should be easy to open preferably by tearing a little piece of the part of the lining which extends above or outside the outer package, and in a particular embodiment the container should be formed so that it may be subjected to a sterilization process.

The invention also refers to a method and an apparatus for manufacturing such containers. Further characteristics of the invention will be evident from the following detailed description in which reference will be made to the accompanying drawings.

In the drawings

Figure 4:
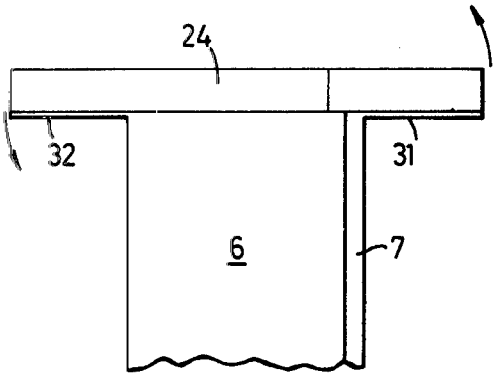
Figure 5:
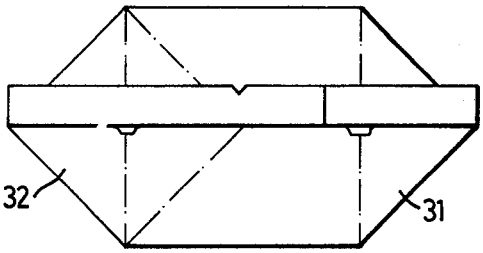

FIG. 4 diagrammatically illustrates the sealing of the package seen from the side and FIG. 5 is a picture of the package according to FIG. 4 seen from above.

Figure 6:
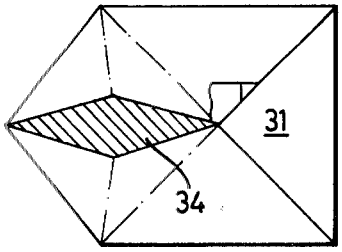
Figure 7:
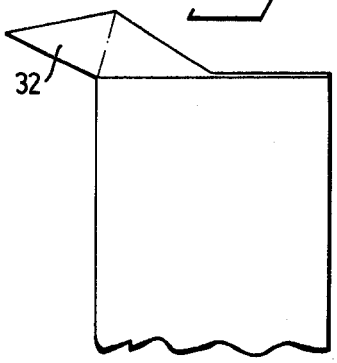

FIGS. 6 and 7 are views from above and from the side showing a part of the package according to the invention in the opened state.

Figure 8:
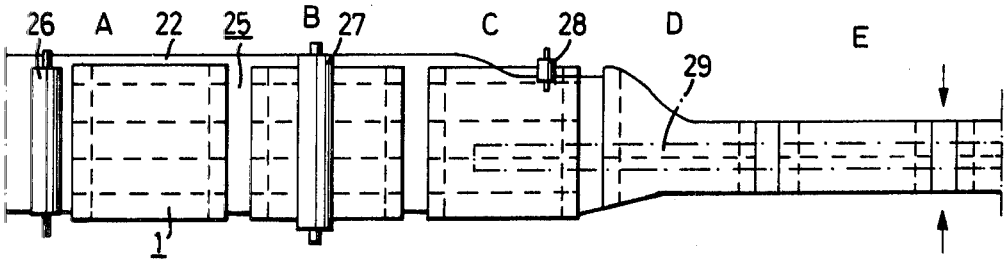

FIG. 8 diagrammatically shows an apparatus for continuous manufacture of a container according to the invention.

Figure 1:
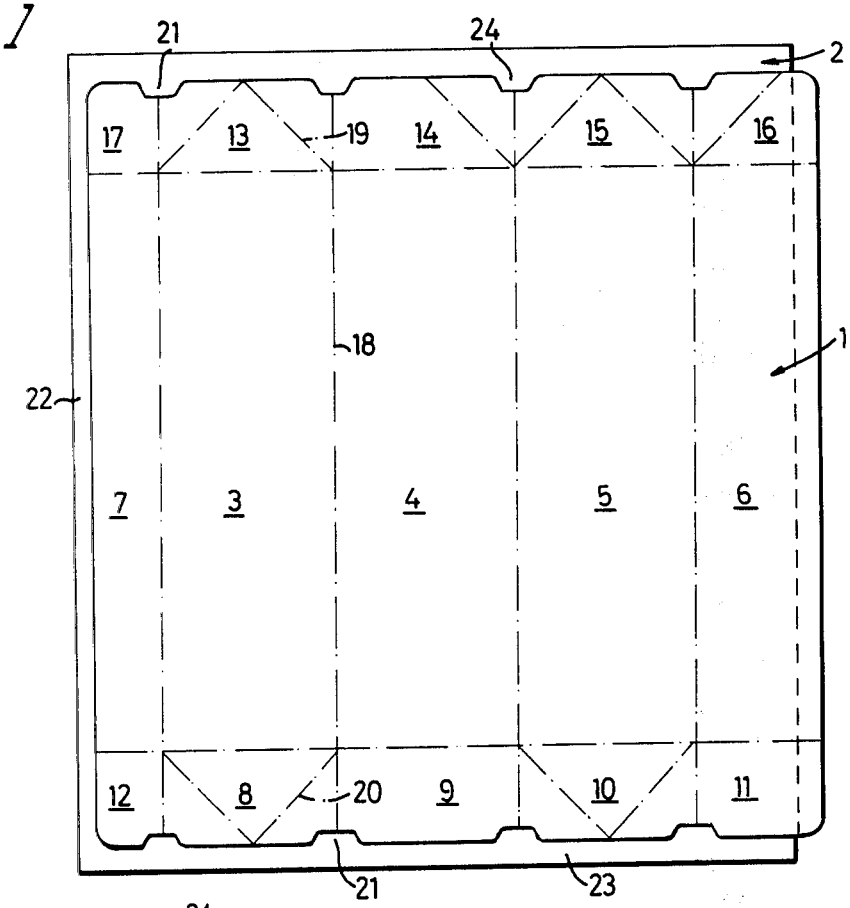
FIG. 1 shows a separate unit including a punched and creased blank for an outer package applied to a lining blank.
Figure 9:
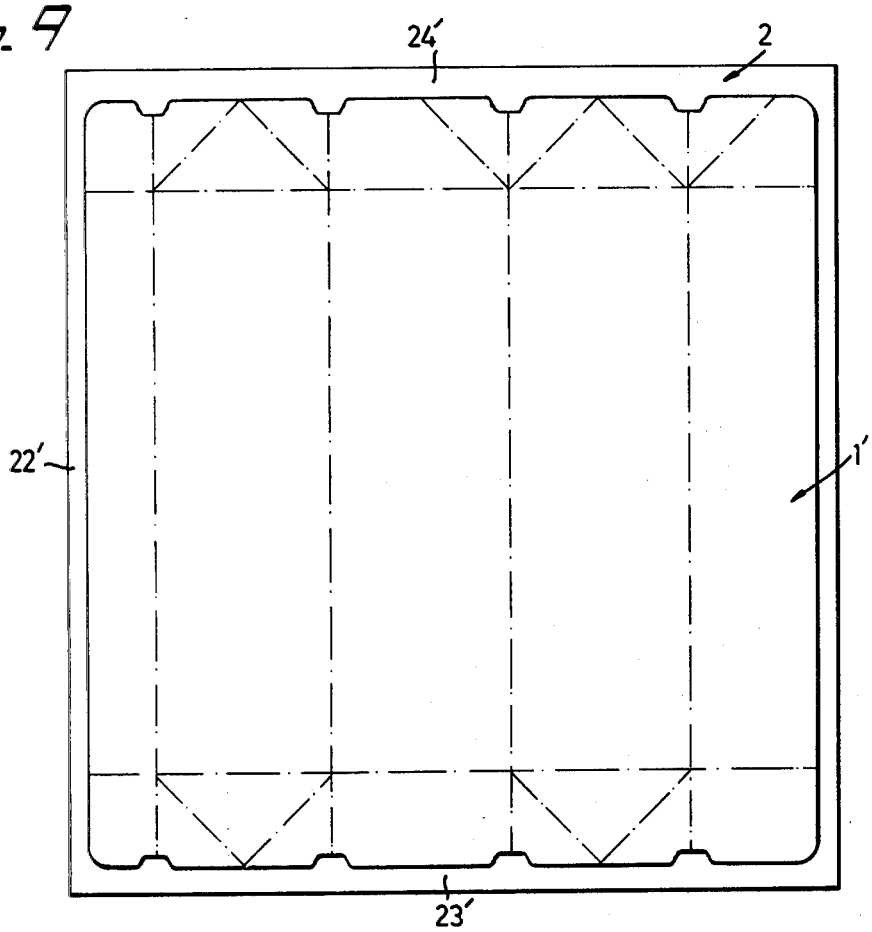
Figure 10:
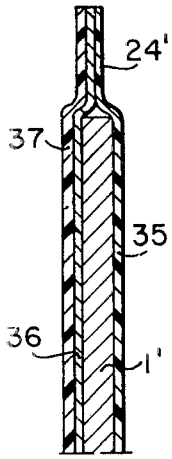

FIG. 9 is similar to FIG. 1 showing a modified embodiment of a container blank and FIG. 10 shows a portion of the container according to FIG. 9 in a cross-sectional view.

Figure 2:
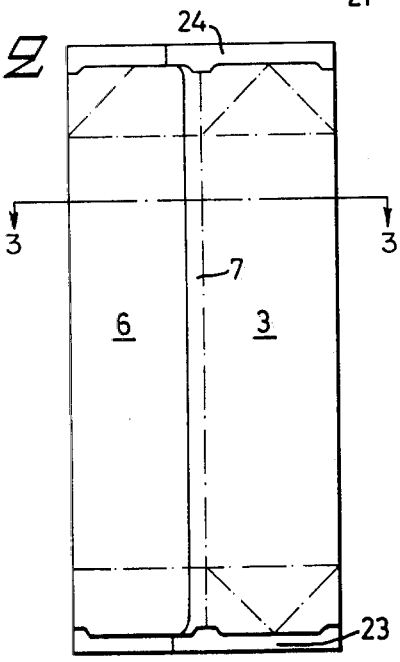
FIG. 2 is in somewhat reduced scale showing the package blank according to FIG. 1 in a phase of the manufacturing.

The container shown in FIGS. 1 and 2 basically comprises a blank 1 for an outer container of cardboard or similar stiff material and a blank 2 for a lining of e.g. plastic, metal, plastic covered paper, plastic covered metal or the like. In a preferred embodiment of the invention the foil material is a free layer material, viz. a thin paper which is covered with a thin aluminium layer and on top of this aluminium layer a thin plastic layer.

The blank for the outer container in the conventional way comprises four container walls 3, 4, 5 and 6 and a narrow attachment flap 7, which in a ready container is attached to the outermost container wall 6. Each container wall and the attachment flap 7 is formed with corresponding bottom flaps 8–12 and lid flaps 13–17. The outermost package wall 6 and its bottom flap 11 and lid flap 16 are somewhat narrower than the remaining container walls 3, 4 and 5 for a purpose which will be explained below. The different parts of the outer container are divided from each other by fold lines like the fold or crease line 18, and the bottom part and the lid part of the outer container blank are in the conventional way formed with fold lines like the lines 19 and 20 intended to provide fold indications during the manufacture of the container. On line with each fold line 18 a cut is formed at the outer edge of the bottom flaps and the lid flaps and the purpose of said cuts are to provide an opening adjacent the fold at the center of the container at the two opposite sides where the bottom flaps and the lid flaps meet each other and where there may be a fold and subsequent damage of the lining when the container is later on closed.

The outer container blank 1 is shown applied to a lining blank, and the said lining blank extends outside the attachment flap 7 with a part 22 and it likewise extends outside the bottom flaps 8–12 with a part 23 and outside the lid flaps 13–17 with a part 24. On the contrary the lining does not extend as far as to the right hand edge of the uttermost container wall 6 as shown in the drawing and this for the purpose that the part of the corner wall 6 which is not covered with lining material may be attached directly to the attachment flap 7 by direct contact of cardboard material against cardboard material to provide a thin and safe joint.

The outer container blank 1 is punched separately and is not applied to the lining blank 2 until in connection to the final formation of the container. An essential advantage of this is that the outer container may be printed prior to the contact with the lining and consequently there are not such strong demands on the most sterile conditions as possible as in the case where the printing is made onto lined containers and there are no strong demands either on use of non-toxic printing colours as otherwise. The creasing of the container blank preferably is made after the printing but it may be made before or after the joining of the outer container blank with a lining blank 2. As mentioned above the joining of the outer container blank 1 and the lining blank 2 does not take place until in connection to the final formation of the complete container blank and this takes place in an apparatus which is schematically illustrated in FIG. 8. It is essential to the invention that the outer container blank 1 and the lining blank 2 are joined so that the lining blank is completely attached to at least the outer container walls 3–6 and the attachment flap 7. The lining may also be attached to the complete outer container blank 1 except for the outermost part of wall 6, but the closing of the package may be accomplished somewhat more simple if the bottom flaps 8–12 and the lid flaps 13–17 are free from the lining blank 2. The attachment of the outer container blank 1 and the lining blank 2 may take place in any suitable way so that the lining is laminated against the side of the outer container blank 1 which is to form the inner side of the container, and the lining thereby should be turned with its plastic or metal side against the interior of the container to be made. The laminating may take place by cold-glueing, hot glueing or welding and as glue may be used some hot glue like hot melt, water glue, glue foils or the like.

The final formation of the container is best illustrated in FIG. 8, and there are diagrammatically illustrated five different stations designated A, B, C, D and E. The lining material is here shown as a continuous path onto which the outer container blanks 1 are successively applied. The cutting of the ready tube-formed container blanks do not take place until after station E and during the process the continuous path of lining material is utilized as feeder path in all stations A–E, and this way a quick safe and disturbance-free manufacturing operation is obtained.

In station A the glue is applied either to the lining path 25 or to the outer container blank 1, whereby the glue may be applied by means of a roller 26 or in any other suitable way. During the continuous feeding of the lining path and the outer container blanks then follow station B, in which a pressing together of the outer package blank and the lining material takes place, and the said pressing together may be accomplished by means of a roller 27, which is forced against a non-illustrated base. The roller 27 may be cold or hot depending on the type of glue which is used. In case a plastic layer existing on the outer container blank 1 or the lining blank 2 is utilized as attachment means the roller 27 should be heated to melt the said plastic material and provide a welding between the two layers of material. The pressing together of the parts 1 and 25 may be performed in any suitable way such as by means of a roller or a press plate and thereby the press plate may have an oscillating movement following the continuous feeding of the lining material path 25 or the feeding of the lining material path may follow intermittently so as to make use of a press plate which is moveable only upwards and downwards. In the case that the lining material path and the outer container blanks 1 are to be joined only along the side walls 3–7 of the container preferably a hot or cold press plate is used which may be formed or adjusted exactly according to the joining which is wanted between the pieces of material.

Thereafter the path of material passes station C, in which the projecting part 22 of the lining material path is bent upwards and is folded downwards along the upper side of the attachment flap 7 and is attached to the said flap in any suitable way. Usually a cardboard material is utilized as material for the outer container, which material is on the upper side thereof covered with a plastic material and in this case the attachment of the lining material part 22 may be accomplished by a hot roller 28, which rolls over the said part and provides a welding together of the lining part 22 and the attachment flap 7.

Figure 3:
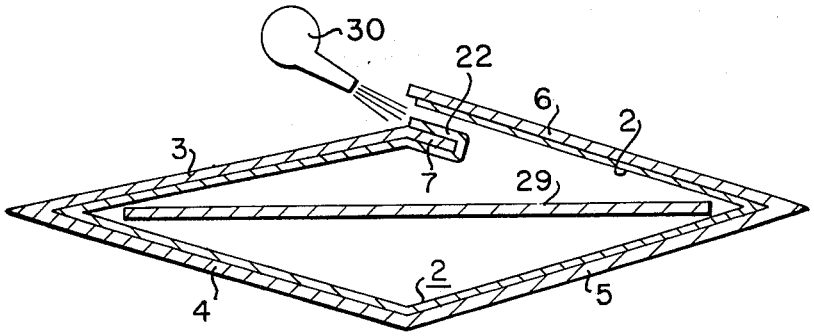
FIG. 3 shows a part of the package according to FIGS. 1 and 2 in a cross-sectional view taken along line 3—3 of FIG. 2 and an apparatus for manufacturing the package in a phase of the manufacturing of the package.

In station D the container side 3, the attachment flap 7 and the its outer container parts and the connected lining material are folded down. With a slight drag a folding down of the container wall 6 and its parts 11 and 16 and the correspoinding part of the lining material takes places at the same time, and the folding down thereby follows over a plate 29 which is located so as to form a holder-on on line with the parts of the container to be joined. From FIG. 3 is evident that the folded-over lining part 22 will be pressed in direct contact with the inner side of the narrow container wall 6 and that the part of said wall which has no lining will be pressed into contact with a part of the attachment flap 7. Since the lining material on the inside of the container to be formed is plastic laminated and the outer container flap on the outside thereof is likewise plastic laminated the joining may be accomplished by means of a hot air means 30 which is heating the plastic material of the lining part 22 and the inner side of the adjacent container wall 6 so that the said material parts are welded together when pressed against each other. The plate 29 in this case avoids a glueing together due to the heat of the remaining parts of the inside of the container. The hot air means 30 may be an elongated tube having a series of nozzles blowing hot air into the cleft between the lining part 22 and the adjacent container wall 6 at the same time as the container blank is advanced so the apparatus. Concurrently with the welding together of the lining parts also the wall 6 of the outer container is welded together with the outside of the attachment flap 7. Following station E the ready container blanks are finally cut apart and the said cutting takes place right across the lining material path 25 along a suitable line between two successive outer container blanks. Depending on the distance between two following outer container blanks a narrower or wider projecting lining part 23 and 24 may be obtained at the bottom end and the top end of the container, but for containers having a volume of about 0.5 liters it is generally sufficient to have a projecting part of between 10 and 20 mm at each end.

The embodiment of the invention shown in FIGS. 9 and 10 is particularly intended as container for such products which ought to be sterilized and for this purpose the container blank comprises a stablizing cardboard blank 1' of the same kind as in FIG. 1 and on each side of said cardboard blank 1' a foil of a sealing material of a type which may stand the temperatures at which sterilizing takes place. Generally sterilizing is performed slightly over 120°C and as example on suitable foils which may stand such temperatures and which are otherwise suitable for the purpose may be mentioned foils of polyethylene plastics which are heat resistant up to about 130°C or polypropylene plastics having a heat resistance of about 150°C.

The cardboard blank 1' is preferably laminated on both sides with such suitable foil so that the foils and the cardboard blank form a solid, co-herent unit and so that the cardboard material is hermetically enclosed between the foils.

As best evident from the example shown in FIG. 10 the cardboard material 1' is enclosed between an outer plastic foil 35 and an inner foil which is a laminated unit of a thin aluminium foil 36 and a plastic foil 37. In order that the cardboard material shall be hermetically enclosed between the plastic foils the said foils must extend outside the entire cardboard blank and the foils are welded together round the edges extending outwards the cardboard material, whereby it is foreseen that the cardboard material has sufficient low content of moist and air to be suited for sterilizing so that no air or damp bubbles will occur in the container during the sterilizing process.

The erecting, the closing, the filling and sealing of the container is accomplished in a way known per se and in short it is accomplished as follows: After the more or less plainly folded blank has been erected the bottom thereof is closed by means of a plane closing rib as indicated in FIGS. 4 and 5, whereby the projecting part 24 of the lining is first welded together, whereupon the closed lining rib is folded down towards the container bottom and the free edge ears 31 and 32 of the outer container are folded inwards towards each other and are attached against the bottom of the container. After filling of the container the top is closed in exactly the same way, but in this case one of the free edge ears 32 may suitably be folded outwards and be attached against the front side of the container. The container is very easily opened by releasing the front free edge ear 32 and the projecting welded lining rib is torned away, whereby the lining itself provides a dispensing spout 33 having a parallelepipedical opening 34.

It is to be understood that the above described invention is only an explanatory example and that all kind of different modifications may be presented within the scope of the appended claims. Accordingly the apparatus for executing the method according to the invention may be structered in several different alternative ways and the above described means may be substituted by other means. E.g. the welding may be accomplished with hot air instead of by means of heated rollers etc.

By the method a container for liquids is obtained which may be manufactured completely gas tight in that the inner container or the lining may be sealed by welding independently of the outer container; and in that each joint of the inner container or the lining is formed by direct contact of lining against lining without intermediate layer of cardboard material of the outer container. Since the lining is laminated at least over the entire surface of the wall parts 3–7 of the outer container there is no risk either that the lining during transportation or careless handling moves in relation to the outer container, whereby there is no risk either that the lining will be damaged due to such movements. The laminating of the lining against the container wall parts 3–7 also leads to the essential advantage that the stability of the lining or inner container itself may be utilized so that the thickness of the cardboard material of the outer container may be reduced correspondingly which leads to an essential reduction of cardboard material and makes the method still more economical. Because of the cuts 21 at the edges of the container it has also been possible to eliminate the risk that the otherwise sharp edges of the outer container will cause a stretching of the lining material when the container is closed, and thereby the risk of rupture of the lining material due to such stretching is thereby eliminated. Due to the laminating of the lining material against the outer container blank the lining follows the outer container strictly into the corners thereof. This is particularly the case when the package is folded after the lining material and the outer container blank have been joined together i.e. the container is folded between the above described station B and C. This is additionally contributed to in that the outermost container wall 6 is narrower than the remaining container walls 3, 4 and 5, whereby the said container walls 6 with the outer edge thereof is located a short distance aside of the corresponding corner of the container.

What we claim is:

1. A fluid tight container comprising:

an outer blank of a stiff material such as cardboard or the like, said outer blank having a plurality of wall panels, each panel having attached thereto a bottom closing flap and a top closing flap;

an inner lining of a flexible material such as plastic, metal foil or the like, said lining being laminated over substantially the entire inner surface of said the wall panels and extending longitudinally beyond the outer periphery of said top and bottom closing flaps and including a portion extending laterally beyond the outer periphery of one side edge of the outer blank, this portion also extending laterally beyond the top and bottom closing flaps of the wall panel at said one side edge;

the said portion of the lining being folded over said one side edge as well as over the side edges of the top and bottom closing flaps at said one side edge, and attached to the outer side of the outer blank; the inside of the outer blank at the side edge thereof opposite from said one side, including the top and bottom closing flaps located at said opposite side edge, being connected to the folded-over portion of the lining;

and each of the portions of the lining located longitudinally beyond the top and bottom closing flaps being sealed together to close that respective end of the container by a flat transverse seal located substantially completely longitudinally beyond its respective closing flaps.

2. A container according to claim 1, the said portion of the lining folded-over the said one side edge of the outer blank being substantially narrower than the wall panel located at the side, and being welded against the inside of the lining at the opposite side of the outer blank.

3. A container according to claim 1, the lining leaving a narrow rib uncovered at said opposite side edge of the outer blank, and said uncovered narrow rib being attached directly to the folded-over portion at the outside of the said one side of the container blank.

4. A container according to claim 1, the outer blank comprising five wall panels forming four container sides and an attachment flap, the side edge of the flap constituting the said one edge of the outer blank over which the said lining portion is folded, the outer free container side being somewhat narrower than the remaining three container sides, so that the outer edge of the said free side, which is the said opposite side edge of the outer blank, is located spaced apart from the corner of the container formed by the attachment flap and its adjacent container side.

5. A container according to claim 1, said container being of parallelepipedical cross-section, and the outer blank being cut down at the extreme ends of each longitudinal fold between the top and bottom closing flaps located at those ends, in order to prevent stretching or fold formation of the lining as a result of sharp folds of the outer blank.

6. A container according to claim 1, the outer blank being hermetically enclosed between a pair of said linings.

* * * * *